US010106313B2

(12) United States Patent
Hu et al.

(10) Patent No.: US 10,106,313 B2
(45) Date of Patent: Oct. 23, 2018

(54) LIQUID CRYSTAL PANEL PACKAGING CASE

(71) Applicant: Shenzhen China Star Optoelectronics Technology Co., Ltd., Guangdong (CN)

(72) Inventors: Qianshuang Hu, Guangdong (CN); Pangling Zhang, Guangdong (CN); Shihhsiang Chen, Guangdong (CN); Yuchun Hsiao, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 427 days.

(21) Appl. No.: 14/784,413

(22) PCT Filed: May 21, 2015

(86) PCT No.: PCT/CN2015/079515
§ 371 (c)(1),
(2) Date: Oct. 14, 2015

(87) PCT Pub. No.: WO2016/183846
PCT Pub. Date: Nov. 24, 2016

(65) Prior Publication Data

US 2016/0362245 A1 Dec. 15, 2016

(30) Foreign Application Priority Data

May 19, 2015 (CN) ..... 2015 1 0254664

(51) Int. Cl.
*B65D 1/34* (2006.01)
*B65D 85/48* (2006.01)
(Continued)

(52) U.S. Cl.
CPC ..... *B65D 85/48* (2013.01); *B65D 25/107* (2013.01); *B65D 81/053* (2013.01)

(58) Field of Classification Search
CPC .... B65D 81/05; B65D 81/054; B65D 81/107; B65D 1/34
(Continued)

(56) References Cited

U.S. PATENT DOCUMENTS 6,308,831 B1 10/2001 Saxe et al.
7,114,618 B2 * 10/2006 Arnold ..... B65D 81/107 206/523
(Continued)

FOREIGN PATENT DOCUMENTS

CN 201264773 7/2009
CN 201419857 3/2010
(Continued)

OTHER PUBLICATIONS

International Search Report for PCT/CN2015/079515, English Translation attached to original, Both completed by the Chinese Patent Office dated Jan. 29, 2016, All together 6 Pages.
Chinese Search Report for Chinese Application No. CN 2015102546645, Completed by the Chinese Patent Office, dated May 23, 2016, 2 Pages.

*Primary Examiner* — King M Chu
(74) *Attorney, Agent, or Firm* — Mintz Levin Cohn Ferris Glovsky and Popeo, P.C.; Kongsik Kim; Jhongwoo Jay Peck

(57) ABSTRACT

A liquid crystal panel packaging case, including a frame body and a base plate, wherein an inside of the frame body is provided with a stepped part, and at least two opposite ends of the base plate are lapped on an upper surface of the stepped part. The packaging case the frame body and the base plate of the liquid crystal panel packaging case individually manufactured in combination. The base plate is used by being lapped on the step of the frame body. The
(Continued)

frame body and the base plate in different packaging bases are interchangeable, so that only the damaged structure needs to be replaced when only a part is damaged, which decreases repair cost.

15 Claims, 3 Drawing Sheets

(51) Int. Cl.
*B65D 25/10* (2006.01)
*B65D 81/05* (2006.01)

(58) Field of Classification Search
USPC ..... 206/453, 454
See application file for complete search history.

(56) References Cited

U.S. PATENT DOCUMENTS

| | | | |
|---|---|---|---|
| 2014/0008267 | A1 | 1/2014 | Chen et al. |
| 2016/0107828 | A1 | 4/2016 | Zhao et al. |

FOREIGN PATENT DOCUMENTS

| | | |
|---|---|---|
| CN | 101920816 | 12/2010 |
| CN | 102717983 | 10/2012 |
| CN | 103381938 | 11/2013 |
| CN | 203473600 | 3/2014 |
| TW | 201408559 | 3/2014 |

* cited by examiner

LIQUID CRYSTAL PANEL PACKAGING CASE

CROSS-REFERENCE TO RELATED APPLICATION

This application is the U.S. national phase of PCT Application No. PCT/CN2015/079515 filed on May 21, 2015, which claims priority to CN Patent Application No. 201510254664.5 filed on May 19, 2015, the disclosures of which are incorporated in their entirety by reference herein.

BACKGROUND OF THE INVENTION

1. Field of the Invention

The present disclosure relates to a packaging structure manufacturing field, particularly to a liquid crystal panel packaging case.

2. The Related Arts

In the liquid crystal display production field, in order to facilitate carrying and storing the liquid crystal display, either semi-finished liquid crystal panels or a finished liquid crystal panels need to be packaged to be conveyed with packaging cases. Currently, there are various packaging methods for the liquid crystal panel in this field, among which the most commonly used method is to apply a tray formed of buffering material by a foaming mould so as to settle the liquid crystal panel.

However, in order to simplify the production process, the existing packaging cases are generally formed integrally, and thicknesses of their bottom are usually increased for improve subjected capacities of the packaging cases. However, once the structure is damaged, the packaging case needs to be replaced, which increases maintenance cost of the packaging case, while the packaging case is heavier, and thus is not convenient for carrying.

SUMMARY

In light of the shortage existed in the prior art, the present disclosure provides a liquid crystal panel packaging case with a lower maintenance cost and a lighter weight.

In order to achieve the above objects, the present disclosure adopts the following technical solutions:

A liquid crystal panel packaging case includes a frame body and a base plate, wherein an inside of the frame body is provided with a stepped part, and at least opposite ends of the base plate are lapped on a upper surface of the stepped part, Wherein, the base plate includes at least one first area formed as a cut-out structure.

Alternately, the base plate includes at least one first area formed as a groove.

Wherein, the first areas are multiple, and at least two first areas are symmetrically disposed at opposite sides of the base plate.

Wherein, the base plate further includes a second area interposed between the two first areas symmetrically disposed at opposite sides of the base plate, and a first reinforcement part is provided at a portion of a bottom surface of the base plate corresponding to the second area.

Wherein, the first reinforcement part extends to an edge of the base plate, and is lapped on the stepped part;

Wherein, the first reinforcement part includes a plurality of reinforcement ribs crossing to each other.

Wherein, an upper surface of the base plate is recessedly disposed corresponding to the second area, and is provided with a second reinforcement part.

Wherein, an upper surface of the second reinforcement part is coplanar with the base plate.

Wherein, the second reinforcement part includes a plurality of reinforcement ribs crossing to each other.

In the present disclosure, the frame body and the base plate of the liquid crystal panel packaging case independently processed are combined for use; the base plate is lapped on the step of the frame body for use, and the frame body and the base plate may be interchangeable in different packaging cases so that only the damaged structure needs to be replaced when only a part is damaged, which decreases the use cost. Meanwhile, the base plate may undergo a thickness reduction process, the base plate may be provided with a cut-out part or a groove therein while a reinforcement rib is provided at the corresponding stressed part, which may reduce the thickness of the base plate effectively, ensure the overall strength of the packaging case while decreasing the weight of the packaging case, and further save raw materials, thereby decreasing manufacturing cost.

DETAILED DESCRIPTION OF EXEMPLARY EMBODIMENTS

In order to make the object, technical solution and advantages of the present disclosure clearer, herein the present disclosure will be further detailed illustrated in connection with the figures and exemplary embodiments. It should be understood that the detailed embodiments described herein are only used to explain the present disclosure rather than to limit the present disclosure.

Embodiment 1

Figure 1:
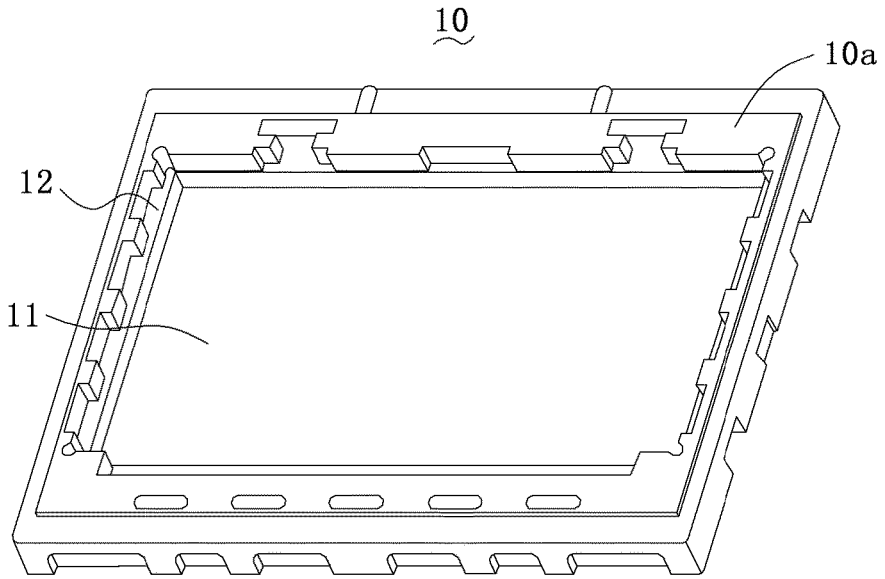
FIG. 1 is a structural diagram of a frame body of a liquid crystal panel packaging case according to Embodiment 1 of the present disclosure.
Figure 2:
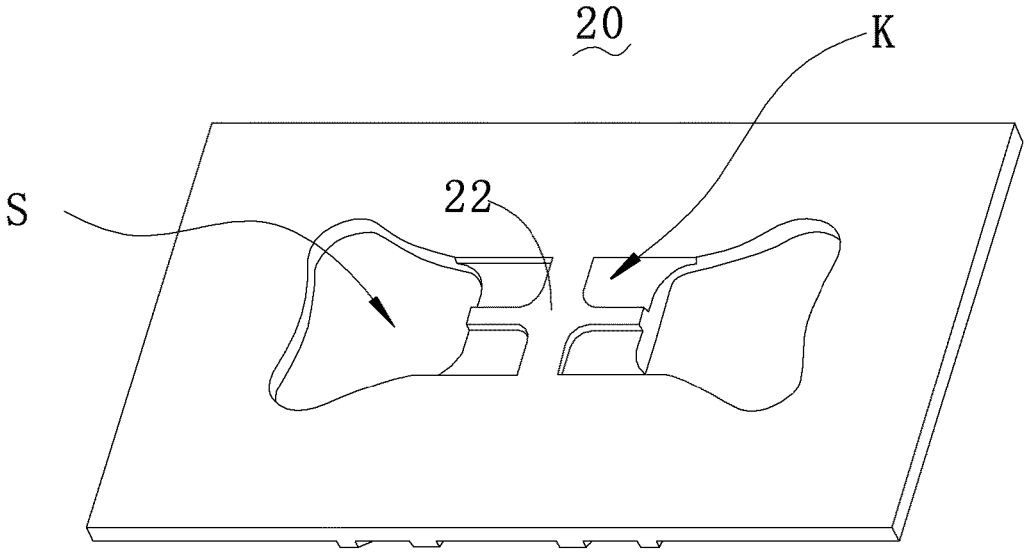
FIG. 2 is a front structural diagram of a base plate of the liquid crystal panel packaging case according to in Embodiment 1 of the present disclosure.
Figure 3:
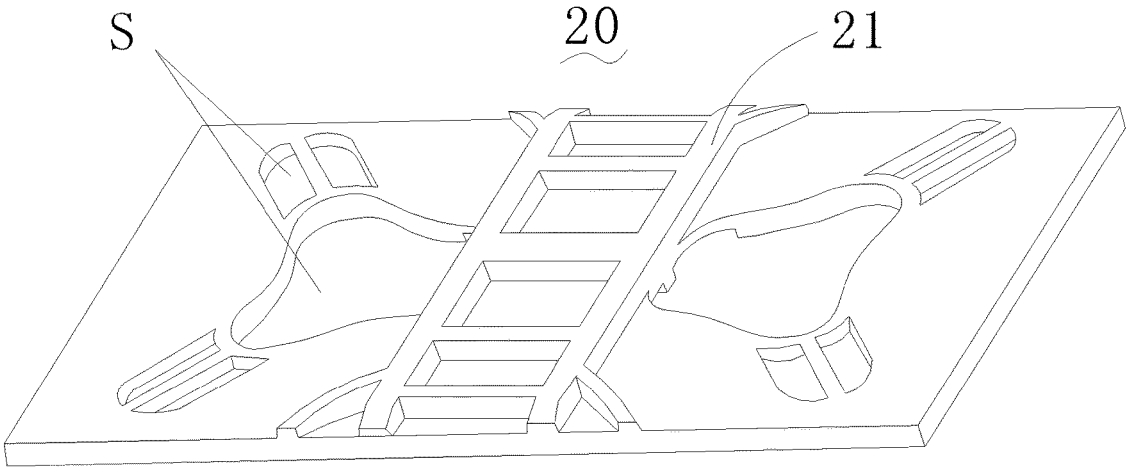
FIG. 3 is a back structural diagram of the base plate of the liquid crystal panel packaging case according to Embodiment 1 of the present disclosure.

As shown in FIG. 1 to FIG. 3, a liquid crystal panel packaging case of the present disclosure includes a frame body 10 having a through hole 11 penetrating through at a middle portion thereof and a stepped part 12 formed at an inside thereof, and a base plate 20 with at least opposite ends lapped on an upper surface of the stepped part 12. The liquid crystal panel may be stacked on the upper surface of the base plate 20 after the base plate 20 is lapped to be assembled into the frame body 10.

In order to facilitate stacking the packaging cases, a middle part of an upper surface of the frame body 10 protrudes to form a square boss 10*a*. Meanwhile, a bottom surface of the frame body 10 recesses inwards to form a step (not illustrated in figures) coupled to the boss 10*a*. When two packaging cases are stacked, an upper packaging case is positionally limited with its step on the bottom surface being caught by the boss 10*a* of a lower packaging case.

With such settings, the frame body 10 and the base plate 20 may be individually designed and manufactured, respectively, so that a thickness of the base plate 20 does not depend on a size of the frame body 10. Meanwhile, a connection structure of the frame body 10 and the base plate 20 is more flexible. Even if one of the frame body 10 and the base plate 20 is damaged after a long time usage, it may be replaced conveniently rather than the whole packaging case being replaced, which greatly saves use and maintenance cost.

The base plate 20 includes at least one first area S provided with a cut-out structure having a hole or with a groove. Such a design may save a part of materials and decrease the weight of the packaging case, which facilitates carrying.

The first areas S may be provided multiple in accordance with requirement. In order to ensure uniformity of overall stress of the base plate 20, the first areas S are symmetrically disposed at opposite sides of a length or a width of the base plate 20.

Furthermore, the base plate 20 further includes a second area K which is interposed between the two first areas symmetrically disposed at opposite sides of the base plate 20; meanwhile, a first reinforcement part 21 is provided at a portion of the bottom surface of the base plate 20 corresponding to the second area K.

The first reinforcement part 21 extends to an edge of the base plate 20, and lapped on the stepped part 12. The first reinforcement part 21 includes a plurality of reinforcement ribs crossing to each other. Here, the plurality of reinforcement ribs which form a ladder shape are disposed at the center part of the base plate 20 in a length direction.

A thickness reduction structure is recessedly formed at the upper surface of the base plate 20 corresponding to the second area K, and a second reinforcement part 22 is disposed at the upper surface of the base plate 20 corresponding to the second area K and includes a plurality of reinforcement ribs crossing to each other. The second reinforcement part 22 of the present embodiment is composed of two reinforcement ribs perpendicular to each other, in which an upper surface of the second reinforcement part 22 is coplanar with the base plate 20, thus facilitating stacking the liquid crystal panels. It may be understood that a width of the reinforcement rib can be adjusted in accordance with actual stress state so as to adapt to the first area S having different cut-out structures or groove structures, which may ensure bearing strength throughout the base plate 20.

Specifically during manufacturing, the base plate 20 is manufactured individually, which may be thinner than normal base plates. The base plate 20 after thickness production processed is provided with symmetrical cut-out structures or grooves, which may realize thickness production of the base plate 20 again. Meanwhile, a first reinforcement part 21 composed of a plurality of reinforcement ribs is protrudingly provided between the cut-out structures of a back surface (bottom surface) of the base plate 20, and a second reinforcement part 22 parallel with the surface of the base plate 20 is protrudingly provided at a front surface (upper surface) of the base plate, thereby ensuring that the base plate 20 has enough strength.

Embodiment 2

Figure 4:
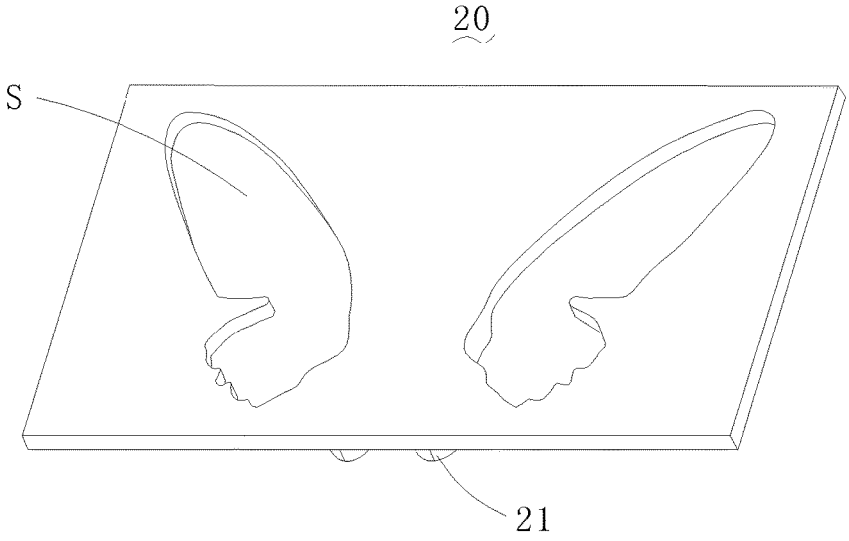
FIG. 4 is a front structural diagram of a base plate of a liquid crystal panel packaging case according to Embodiment 2 of the present disclosure.
Figure 5:
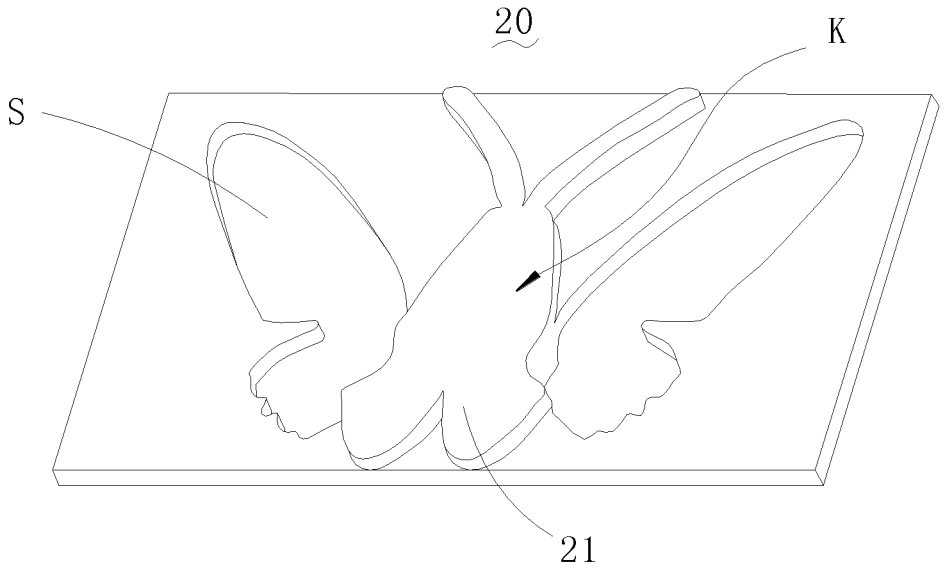
FIG. 5 is a back structural diagram of the base plate of the liquid crystal panel packaging case according to Embodiment 2 of the present disclosure.

As illustrated in FIG. 4 and FIG. 5, a base plate 20 of the present embodiment has two first areas S symmetrically disposed at two sides of the base plate 20 in a length direction, each of which is a through hole structure or a cut-out structure. A second area K between the two first areas S is provided with a first reinforcement part 21 composed of reinforcement ribs having different widths. Specifically, the two first areas S are arranged in a shape of Chinese character "A", parts of the two first areas close to each other are connected by a wider reinforcement rib, and the ends far apart from each other are connected by using a narrower reinforcement rib.

The above only describes specific embodiments of the present application, and it should be pointed out that, to those ordinary skilled in the art, several improvements and modifications can be made without escaping from the principle of the present application, which should be considered to be fallen within the protection scope of the present application.

What is claimed is:

1. A liquid crystal panel packaging case, comprising: a frame body and a base plate, wherein an inside of the frame body is provided with a stepped part, and at least opposite ends of the base plate are lapped on an upper surface of the stepped part, and the base plate comprises at least two first areas; and wherein the base plate further comprises a second area interposed between the two first areas, an upper surface of the base plate is recessedly disposed corresponding to the second area, and a first reinforcement part is provided at a portion of a bottom surface of the base plate corresponding to the second area.

2. The liquid crystal panel packaging case according to claim 1, wherein each first area is a cut-out structure.

3. The liquid crystal panel packaging case according to claim 1, wherein each first area is a groove.

4. The liquid crystal panel packaging case according to claim 2, wherein the at least two first areas are symmetrically disposed at opposite sides of the base plate.

5. The liquid crystal panel packaging case according to claim 4, wherein the first reinforcement part extends to an edge of the base plate, and is lapped on the stepped part.

6. The liquid crystal panel packaging case according to claim 4, wherein the first reinforcement part comprises a plurality of reinforcement ribs crossing to each other.

7. The liquid crystal panel packaging case according to claim 4, wherein an upper surface of the base plate is provided with a second reinforcement part.

8. The liquid crystal panel packaging case according to claim 7, wherein an upper surface of the second reinforcement part is coplanar with the base plate.

9. The liquid crystal panel packaging case according to claim 7, wherein the second reinforcement part comprises a plurality of reinforcement ribs crossing to each other.

10. The liquid crystal panel packaging case according to claim 3, wherein the at least two first areas are symmetrically disposed at opposite sides of the base plate.

11. The liquid crystal panel packaging case according to claim 10, wherein the first reinforcement part extends to an edge of the base plate, and is lapped on the stepped part.

12. The liquid crystal panel packaging case according to claim 10, wherein the first reinforcement part comprises a plurality of reinforcement ribs crossing to each other.

13. The liquid crystal panel packaging case according to claim 10, wherein an upper surface of the base plate is provided with a second reinforcement part.

14. The liquid crystal panel packaging case according to claim 13, wherein an upper surface of the second reinforcement part is coplanar with the base plate.

15. The liquid crystal panel packaging case according to claim 13, wherein the second reinforcement part is a plurality of reinforcement ribs crossing to each other.

* * * * *